United States Patent [19]

Pizur, Sr.

[11] 4,217,378

[45] Aug. 12, 1980

[54] METHOD OF PRODUCING A DECORATIVE EFFECT ON PLANAR SURFACES AND ARTICLES PRODUCED THEREBY

[76] Inventor: Stephen J. Pizur, Sr., 905 Oak Ave., Barnesboro, Pa. 15714

[21] Appl. No.: 925,767

[22] Filed: Jul. 18, 1978

[51] Int. Cl.[2] ..... B05D 3/12; B05D 5/00

[52] U.S. Cl. ..... 427/259; 427/260; 427/262; 427/264; 427/265; 427/266; 427/274; 427/277

[58] Field of Search ..... 427/269, 270, 277, 259, 427/264, 265, 266, 260, 262, 274; 428/152, 195, 203, 204, 210; 264/80

[56] References Cited

U.S. PATENT DOCUMENTS

| | | | |
|---|---|---|---|
| 409,834 | 8/1889 | Endres et al. | 427/269 X |
| 2,510,967 | 6/1950 | Flanagan | 428/152 X |
| 3,515,619 | 6/1970 | Barnette | 428/195 X |
| 3,607,380 | 9/1971 | Thams | 427/277 X |

*Primary Examiner*—Evan K. Lawrence

*Attorney, Agent, or Firm*—Clarence A. O'Brien; Harvey B. Jacobson

[57] ABSTRACT

A method is disclosed for producing a decorative and artistic effect on a flat surface, preferably a clear, flat surface, by brushing or spraying a colored coating material, such as paint thereon, placing a sheet of flexible film on the coated surface, pressing in place until the coating dries, and then removing the film to leave a decorative patterned coating. The resultant monoprint can be used as a room divider, lamp shade, window presenting the effect of stained glass, or for other purposes. When a clear, flat surface is used, the monoprint formed can be sprayed with a contrasting color and arranged to present the uncoated side for viewing in use. The flexible film can optionally be initially distorted by application of heat, creasing, or otherwise to produce variations in the decorative or artistic effect. When two flat surfaces are coated by application to opposite surfaces of flexible film, a decorative laminated structure is created for use as a window, screen wall, lamp shade, or in any suitable opening for partial transmission of light. Articles produced by this method are also encompassed within the invention.

8 Claims, 9 Drawing Figures

Fig. 1
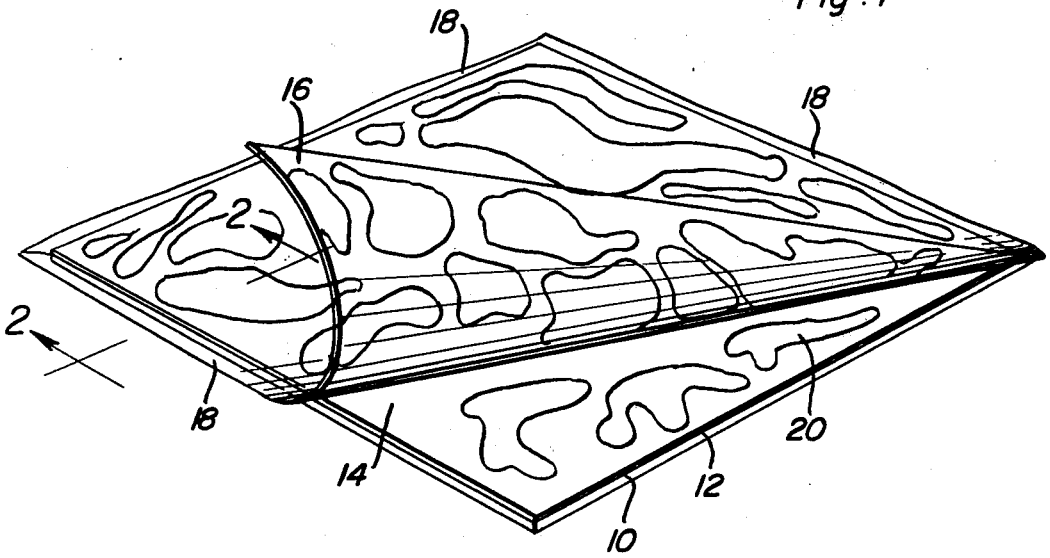
Fig. 2
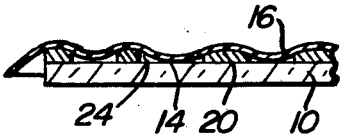
Fig. 3
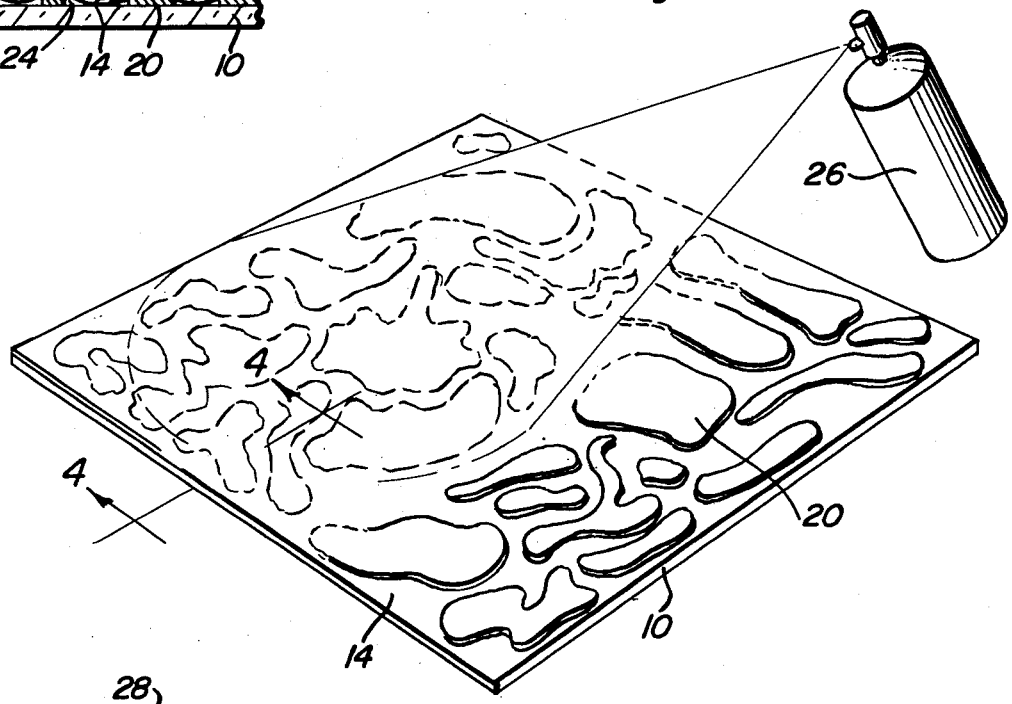
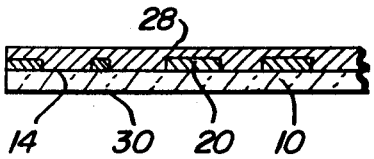
Fig. 4

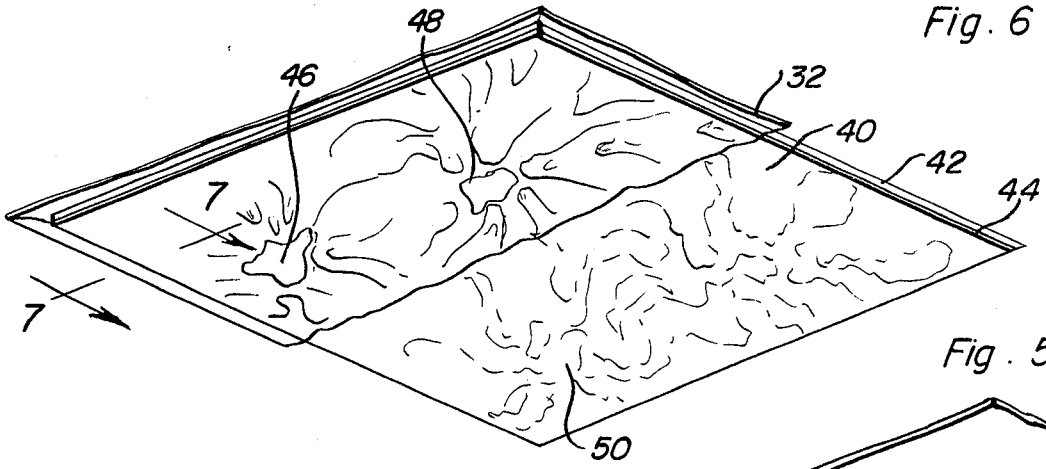
Fig. 6
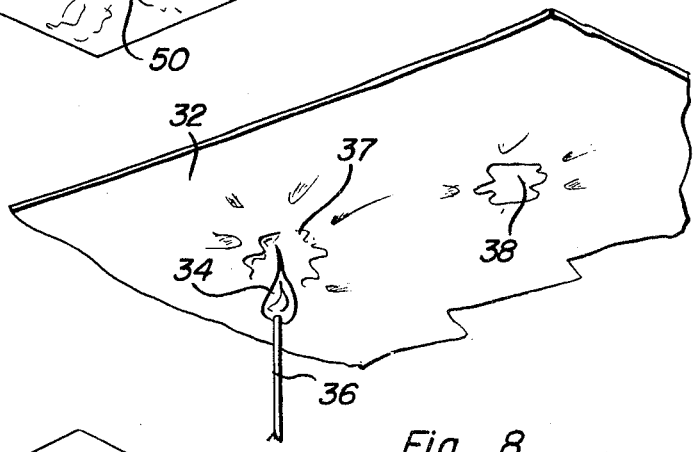
Fig. 5
Fig. 7
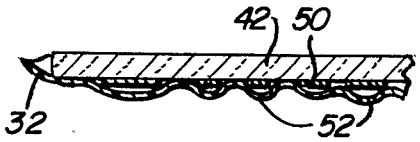
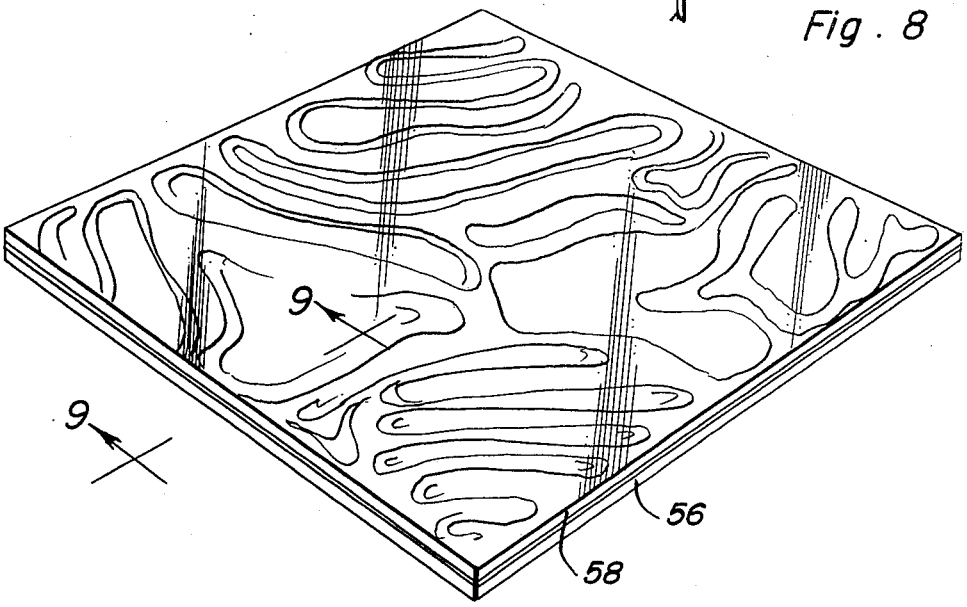
Fig. 8
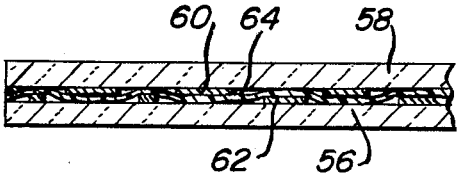
Fig. 9

METHOD OF PRODUCING A DECORATIVE EFFECT ON PLANAR SURFACES AND ARTICLES PRODUCED THEREBY

BACKGROUND OF THE INVENTION

1. Field of the Invention

This invention relates to a method for producing a decorative and artistic effect on flat surfaces for use in openings for partial transmission of light, such as windows, lamp shades, and the like. More particularly, the invention contemplates application of paint or other colored coating material on a glass or clear plastic sheet by brushing or spraying one or a plurality of colors thereon, placing and pressing a sheet of flexible film on the flat surface and allowing the paint to dry, and then removing the film to leave a decorative patterned coating for use or for coating with a contrasting background color to provide an article for use.

2. Description of the Prior Art

Herzog in U.S. Pat. No. 286,434, issued Oct. 9, 1883, describes an imitation stained glass formed from two spaced plate-like members, where colored material produces a pattern between the spaced members. Mixtures such as waxes and cements are applied to the surface of glass to form opaque leaded lines within which intermediate coloring is applied. Considerable skill is required to produce an artistic effect, and considerable time and effort is required to produce each article.

Nicholson in U.S. Pat. No. 1,804,508, issued May 12, 1931, describes a transparent tile as an ornamental article with a transparent plate having a pattern formed on the rear surface. It is necessary to cut a stencil to a desired design and apply through the stencil a granulated colored mineral substance to the underlying tile. The article produced cannot be used for applications in which translucency is required, nor is the article easily and rapidly produced in a variety of artistic and decorative effects.

U.S. Pat. No. 2,095,402, to Stark, Jr., issued Oct. 12, 1937, and U.S. Pat. No. 2,080,337, to Powell, issued May 11, 1937, disclose decorative structures where a pattern is formed from decorative materials applied to the rear surface of a transparent plate. Each design must be outlined upon the surface of the glass by an artist using various suitable media. Such a process is time consuming, not adapted to mass production techniques, and requires considerable artistic skill. U.S. Pat. No. 682,769, to Thorpe, issued Sept. 17, 1901, similarly shows a process for lettering glass signs on the reverse surface and suffers from the same drawbacks.

SUMMARY OF THE INVENTION

An object of the invention is to provide a method for producing decorative and artistic effects on a planar surface rapidly, easily, and without artistic training, experience, or skill, even a seven or eight year old child being capable of practicing the invention as a learning experience in the appreciation of art.

Another object of the invention is to provide a method for proceeding with such a process by reliance on the discovery that pressing a film of flexible plastic upon a freshly painted rigid flat surface by a non-artist creates a decorative and artistic effect by the mere application of such film. Consequently, such a non-artist can easily create an entire painted surface in an artistic design without application of artistic experience or skill by brushing or spraying a color coated material, such as paint, on a rigid glass or sheet plastic surface in one or a plurality of colors. A flexible film of plastic is applied to the wet painted surface, a weight is placed to hold the film in place, and cause the paint to adhere to the film, and the weight is left in place until the paint dries. Removal of the film leaves a decorative patterned coating. The resultant monoprint can be sprayed with a contrasting color to permit observation of a background color through the unpainted side.

Still another object is to first distort the flexible film by application of heat, by creasing, bending, or other means, giving the potential for greater variations.

Yet another object is to paint two flat surfaces with a flexible film sandwiched between the two surfaces, the laminated structure formed thereby being used after the paint dries.

These together with other objects and advantages which will become subsequently apparent reside in the details of construction and operation as more fully hereinafter described and claimed, reference being had to the accompanying drawings forming a part hereof, wherein like numerals refer to like parts throughout.

BRIEF DESCRIPTION OF THE DRAWINGS

FIG. 1 is a perspective view of an embodiment of an article prepared by the method of the present invention, showing the step of removing flexible film to expose the monoprint article.

FIG. 2 is a fragmentary enlarged sectional view of the article shown in FIG. 1, taken substantially upon a plane passing along section line 2—2 of FIG. 1.

FIG. 3 is a perspective view of a monoprint, such as formed by the method illustrated in FIG. 1, showing spraying of a background contrasting color.

FIG. 4 is a fragmentary enlarged sectional view of the article of FIG. 3 after spraying, taken substantially upon a plane passing along section line 4—4 of FIG. 3.

FIG. 5 is a perspective view of a sheet of plastic on which a substantially smokeless flame is applied to create a pattern of localized shrinkage and surface distortion.

FIG. 6 is an upward perspective view of a second embodiment of the invention, showing the film of FIG. 5 after application according to the method of the present invention to a coated flat surface and application of a weight to hold the film in place.

FIG. 7 is a fragmentary enlarged sectional view of the article of FIG. 6, taken substantially upon a plane passing along section line 7—7 of FIG. 6.

FIG. 8 is a perspective view of a third embodiment of the present invention showing a laminated structure comprising two coated flat clear surfaces with an intermediate flexible film sandwiched between and in contact with the coated surface.

FIG. 9 is a fragmentary enlarged sectional view of the article of FIG. 8, taken substantially upon a plane passing along section line 9—9 of FIG. 8.

DESCRIPTION OF THE PREFERRED EMBODIMENTS

A rigid planar material 10, shown in FIG. 1 with a bevel 12, is made of glass, sheet plastic or similar material. A colored liquid coating composition is then applied to flat surface 14 of material 10 by brushing or spraying, with application of one color or a plurality of colors, without allowing any of the applications to dry. Flexible film 16, preferably extending a short distance beyond the edges of material 10, as shown in FIG. 1 with overlapping edges 18, is then placed upon the painted surface 14 of material 10 before the color coating composition dries. Throughout the specification and claims, references to paint as a color coating material are to be understood to encompass other types of coating material, such as varnishes, suspensions of metallizing agents, stains, and other coating materials known in the art. Flexible film 16 is then pressed against material 10 by placing a weight, such as a second sheet of glass or plastic upon film 16 and left in place until the paint, represented in FIG. 1 by the numeral 20, has dried. The weight is then removed, and film 16 is peeled from the surface 14 of material 20, as indicated by the arrow in FIG. 1. Upon removal of film 16, material 10 comprises a monoprint with a decorative and artistic effect created by the action of flim 16 under the applied weight. An artistic decorative pattern has been found to result even when the paint applied to surface 14 has been applied by an individual without artistic training or experience. Creation of such a serendipitous artistic result has been found to result solely from the spreading of paint within the region between the film 16 and surface 14, as shown in FIG. 2, where this region is partly occupied by paint 20 and empty space 24, where no paint adheres to surface 14 and projecting surfaces of the film contact the rigid planar material 10. It should be understood that the corrugations indicated in FIG. 2 are somewhat exaggerated in the vertical dimension in order to properly illustrate the working of the invention.

In FIG. 3, rigid planar material 10 is shown with regions of dried paint 20, prepared in the manner described above in connection with FIGS. 1 and 2. Aerosol or spray can 26 is shown in the process of application of a background color to surface 14 resulting from the paint applied from spray can 26. In order to properly indicate the partially hidden designs beneath the applied background color, these are shown in broken outline in FIG. 3. FIG. 4 represents the applied background paint 28, under which the decorative pattern formed from paint 20 can be seen. When viewed from the uncoated surface, shown as the lower surface 30 in FIG. 4, an opaque design is visible, suitable for use as a coffee table top, dresser top, or the like. Accordingly, when in use, the article produced in this embodiment of the invention will ordinarily be used in a form inverted from that shown in FIGS. 3 and 4.

It is to be understood that FIG. 2 represents an article in uncompleted form at an intermediate step of the method of the present invention, while FIG. 4 represents a finished article after completion of the last step in the method.

FIG. 5 is a representation of a sheet of flexible film 32 under action of flame 34 applied from stem 36. Local distortion of film 32 occurs in the vicinity of flame 34, producing a wavy irregular surface texture 37 radiating outwardly from the point of application of flame 34. A similar region of local distortion occurs at region 38, and such regions can be distributed throughout the surface of film 32. It is important to apply flame 34 with care, to prevent forming a hole in film 32.

In FIG. 6, the film prepared in the manner illustrated in FIG. 5 has been applied to the lower surface 40 of rigid planar material 42, having a bevel 44. Paint 50 or other colored coating material is applied to surface 40 in the same manner as described and illustrated above in connection with FIG. 1, but regions 46 and 48 of local surface distortion in film 32 cause a distinctive pattern of paint 50 to result. FIG. 7 illustrates the effect resulting when film 32 having surface distortion, creating ridges 52, produces the pattern illustrated. FIG. 8 illustrates a third embodiment of the invention, where two sheets of rigid planar material 56 and 58 have been separately painted, having application of paint 60 to upper surface 58 and paint 62 to lower surface 56. Before the painted surfaces have had an opportunity to dry, flexible film 64 is applied between the painted surfaces and the surfaces are pressed toward each other by application of a weight or solely by action of the weight of upper surface 58. When the regions of paint 60 and 62 have dried, the entire article is usable, such as the top for a coffee table, as a part of various articles of furniture, as abstract art when framed and hung from a wall, or in applications where diffuse passes through the article, such as for room dividers, lamp shades, or windows presenting the effect of stained glass.

It is to be understood that when a quickly drying paint is utilized, the steps of the method of the present invention must be carried out rapidly to avoid lack of adhesion and spreading of paint when contacted with the flexible film. A retarder, such as paint thinner or oil, can be applied to the surface of the rigid planar material to be painted in order to inhibit the drying of applied paint, thereby permitting use of a fast drying paint and carrying out of the invention in an unhurried manner. The paint can be applied in one color or many colors can be applied by spray or brush, or by a brush using different strokes. When more than one color is applied, the colors tend to mix to produce a distinctive decorative effect.

In practicing the invention, a suitable flexible film is made from polyethylene 0.004 inches in thickness, although other thicknesses can also be used. When the second embodiment of the invention is practiced, with local distortion of the film by a flame, the flame is applied beneath the film just long enough and close enough to melt the film slightly without breaking the surface of the film. Intervals of about four to six inches on the entire film surface can be flame distorted to produce a very pleasing painted surface according to the method giving the article of the second embodiment. It is to be understood, however, that different thicknesses, different materials, and different spacings are contemplated and desirable, the method of the invention offering the possibility of producing a large number and great variety of startling effects through such variations. While a substantially smokeless flame is illustrated in FIG. 5 as the method of applying the region of local distortion 38, other sources of heat can also be used, such as a length of electrically heated wire, a hot plate, soldering iron tip, and the like. Furthermore, folding and pressing of the flexible film can be used instead or in addition, producing either a random or geometrically arranged pattern of folds which allow creation of lines and other different effects in the article produced.

It should also be emphasized that, although the invention can be practiced with an opaque rigid planar material, it is preferred that a clear material be used. In this case, it is possible to observe the painted glass or sheet plastic as the flexible film is applied to the planar material, and a degree of control of the final product can be exercised by adjusting the application of pressure between the film and planar material.

Although use of the method of the present invention results in articles having a decorative and artistic effect, it is not necessary that the user of the invention have experience or skill as an artist. In fact, it is possible for a child as young as seven or eight years of age to produce an artistic effect without difficulty. For reasons of safety, the rigid planar material in such an instance should be sheet plastic, rather than glass, and kits containing such material, along with a supply of paints, brushes, and flexible film are useful for instructional purposes to teach children an appreciation and understanding of art by creating artistic effects themselves.

In yet another variation of the present invention, the flexible film can be left on the rigid planar material, rather than removed as illustrated in FIG. 1, after the paint has dried. If such film is then sprayed with paint of any desired color, a three-dimensional effect through the surface of the planar material will result. Such a variation is possible for the embodiments illustrated in FIGS. 1 and 6.

The foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as new is as follows:

1. A method for producing a decorative patterned coating on a rigid planar material comprising the following steps:

(a) preparing a flexible plastic film locally distorted by application of a substantially smokeless flame beneath the film just long enough and close enough to melt the plastic film slightly without breaking the surface of the film, whereby a distorted wavy irregular surface texture is produced radiating outwardly from point of application of the flame;

(b) applying a liquid coating composition to the rigid planar support material;

(c) placing the distorted wavy irregular surface textured film from step (a) upon the coated surface formed in step (b) without allowing the coating composition to dry;

(d) applying compression means to hold projecting surfaces of the film in contact with said rigid planar material thereby causing spreading of the coating and exposure of portions of said planar material;

(e) allowing the coating composition to dry;

(f) removing the compression means; and (g) removing the film, leaving said decorative patterned coating.

2. The method of claim 1, together with the additional step after step (g) of spraying the patterned coated side of the rigid planar material with a second coating composition of a contrasting color and allowing th second coating composition to dry.

3. The method of claim 1 wherein said flexible plastic film is polyethylene having a thickness of about 0.004 inch.

4. The method of claim 3 wherein said compression means comprises a weight to hold said film in place.

5. The method of claim 4 wherein said weight is a sheet of rigid material.

6. The method of claim 4 wherein said liquid coating composition is applied by a brush or by spraying.

7. The method of claim 6 wherein said rigid planar material is glass or clear sheet plastic.

8. The method of claim 7 wherein said liquid coating composition is applied in a plurality of colors.

* * * * *